US007784729B1

(12) United States Patent
Hope

(10) Patent No.: US 7,784,729 B1
(45) Date of Patent: Aug. 31, 2010

(54) STABLE WIRE SPOOL CART

(76) Inventor: Lloyd Hope, 18226 County Rd. 349, St. Joseph, MO (US) 64505

( * ) Notice: Subject to any disclaimer, the term of this patent is extended or adjusted under 35 U.S.C. 154(b) by 63 days.

(21) Appl. No.: 12/078,602

(22) Filed: Apr. 2, 2008

(51) Int. Cl.
*B65H 16/02* (2006.01)

(52) U.S. Cl. ..... 242/557; 242/597.4; 242/597.8

(58) Field of Classification Search ..... 242/557, 242/594.4, 594.6, 588, 588.2, 597.4, 597.8
See application file for complete search history.

(56) References Cited

U.S. PATENT DOCUMENTS

| | | | | |
|---|---|---|---|---|
| 2,229,787 | A | 1/1941 | Abbott | |
| 2,705,114 | A | 3/1955 | Worsham | |
| 3,178,129 | A | 4/1965 | Parkinson | |
| 3,856,230 | A | 12/1974 | Zimmer | |
| 3,990,650 | A | 11/1976 | Devine | |
| D269,388 | S | 6/1983 | Smith et al. | |
| 4,564,152 | A | 1/1986 | Herriage | |
| 4,611,645 | A | 9/1986 | Whisnant | |
| 4,705,283 | A | 11/1987 | Kleisath | |
| 5,275,349 | A | 1/1994 | Tussing | |
| 5,285,981 | A | 2/1994 | Pavelka | |
| 5,316,232 | A | 5/1994 | Lambert, Jr. | |
| 6,116,533 | A * | 9/2000 | Elder | 242/594.4 |
| 6,182,920 | B1 | 2/2001 | Watkins | |
| 6,286,184 | B1 * | 9/2001 | Dean et al. | 16/35 R |
| 6,422,504 | B1 * | 7/2002 | Elder | 242/594.6 |
| 6,523,776 | B1 | 2/2003 | Elder | |
| 6,634,592 | B1 * | 10/2003 | Berousek | 242/594.3 |
| D491,330 | S | 6/2004 | Violo | |
| 7,150,459 | B2 | 12/2006 | Anderson et al. | |
| 7,243,876 | B2 | 7/2007 | Robison | |
| 2009/0224498 | A1 * | 9/2009 | Diedericks | 280/79.6 |

* cited by examiner

*Primary Examiner*—John Q Nguyen
*Assistant Examiner*—Juan J Campos
(74) *Attorney, Agent, or Firm*—Paul R. Martin

(57) ABSTRACT

A cart for supporting and transporting spools of wire in a stable manner comprises a base having a wire spool supporting frame and wheels thereon, the base having a first section and a second section with the first section being located forward of the second section when the base is in use; a plurality of wire spool supporting arms on the frame; and a second plurality of wire spool supporting arms mounted on the frame at a location that is between the first plurality of wire supporting arms and the base and which is located closer to the second section of the base than to the first section of the base.

7 Claims, 8 Drawing Sheets

STABLE WIRE SPOOL CART

TECHNICAL FIELD OF THE INVENTION

The present invention relates in general to the wiring installation industry, and more particularly to carts for supporting spools of wire.

BACKGROUND OF THE INVENTION

In the business of an electrician, particularly as applied to the service and maintenance work in large industrial or institutional establishments, there is frequently the need for supplying wire in large amounts of varying sizes. Wire used in the electrician's trade is supplied on spools of various sizes. Some spools are quite large and can be very heavy when full. Moving such heavy weights is a common source of injury. Other spools are considerably smaller, and may be six inches or less in diameter. Where several sizes of wire are to be used the work of handling several reels often becomes extremely burdensome even for several workmen.

At the present time, cables of various sorts are used to connect the many pieces of digital and/or communications equipment that may be used in offices, control rooms and the like. Accordingly, construction electricians must typically have at hand many different types of electrical cables for completing a construction project. These types of cables may differ in many aspects. For example, different wire gauges are typically employed throughout a building. In large commercial, institutional, and industrial projects served by multiphase electrical supply systems, the various phases and neutral conductors are usually distinguished by color coding of the insulating jacket. Some applications require stranded conductors, while others require solid, single filament conductors. Therefore, a wide variety of electrical cables area typically required in each construction project.

When the equipment is installed, or if it is reconfigured later, it is necessary to run hundreds, even thousands, of feet of such cable. The cable is typically provided on spools and is unwound, or dispensed, from these spools as needed. Because of the weight and bulk of the cable, most conventional cable-pulling operations use 1000-foot spools, which weigh approximately 30 pounds each. Because normal cable usage typically results in a scrap of cable at the end of the spool that is too short to use cost-effectively, these scraps are considered waste. Research has revealed the length of the average scrap to be approximately 100 feet, or ten percent of a 1000 foot spool. The scrap length is independent of the volume of cable originally on the spool, so the use of larger capacity spools would result in a correspondingly lower percentage of scrapped cable. It is therefore desired to provide a means for dispensing cable that allows use of larger capacity spools.

It is preferred to work with spools of significant length of cable to avoid frequent depletion of a spool. Illustratively, many electricians prefer to work with spools containing 2,500 feet of cable. As wire gauge increases, the various spools become correspondingly heavy. It would be impractical to carry individual spools of wire from place to place within a construction site.

Safely transporting a large spool about a work site and unreeling wire from the spool are difficult without a suitable cart or hand truck and a rack to support the spool. An electrician may also need several smaller spools at hand while working with a large spool. While the inventor is aware of carts and hand trucks suitable for small spools, there is a need for a means which can lift, support and transport a large main spool, along with several small auxiliary spools, and which can also serve as a support rack while wire is unreeled from the spools.

Many currently available devices for supporting cable spools during usage do not typically provide for the simultaneous dispensing of cable from multiple spools; therefore, make-shift cable dispensing devices are sometimes jerryrigged and may even include one or more lengths of pipe inserted through the rungs of a step ladder to form a crude axle for each spool. More commonly, the spools supplying the cable are positioned at the installation site on their ends so that they do not roll as the cable is unwound. The cable installer has to make sure that the cables do not become tangled or kinked as they unwind.

Therefore, there is a need for a cart for supporting, transporting, dispensing and storing a plurality of wire supporting reels and which includes a guide which efficiently guides the wire as it is being dispensed.

Still further, when a cart such as discussed above is loaded with several spools of wire it is imperative that the cart be stable. This is especially so if the cart is used on a construction site and is moved from place to place over terrain that may be uneven. In addition to the stability of such a cart being adversely affected by uneven terrain, if some of the wire spools are full while others are nearly empty or some of the wire spools are heavy while others are lighter, the stability of the cart may be adversely affected. If the cart is not extremely stable, it may tip over during transit from one place to another, or even during use. Such a situation is undesirable.

Therefore, there is a need for a cart for supporting, transporting, dispensing and storing a plurality of wire supporting reels and which is stable during use.

SUMMARY OF THE INVENTION

The above-discussed disadvantages of the prior art are overcome by a cart for supporting and transporting spools of wire in a stable manner. The cart comprises a base having a wire spool supporting frame and wheels thereon, the base having a first section and a second section with the first section being located forward of the second section when the base is in use; a plurality of wire spool supporting arms on the frame; and a second plurality of wire spool supporting arms mounted on the frame at a location that is between the first plurality of wire supporting arms and the base and which is located closer to the second section of the base than to the first section of the base.

Using the embodying the present invention will permit stable storage and transport of spools of wire on uneven terrain, even when the weight of the spools is unbalanced.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
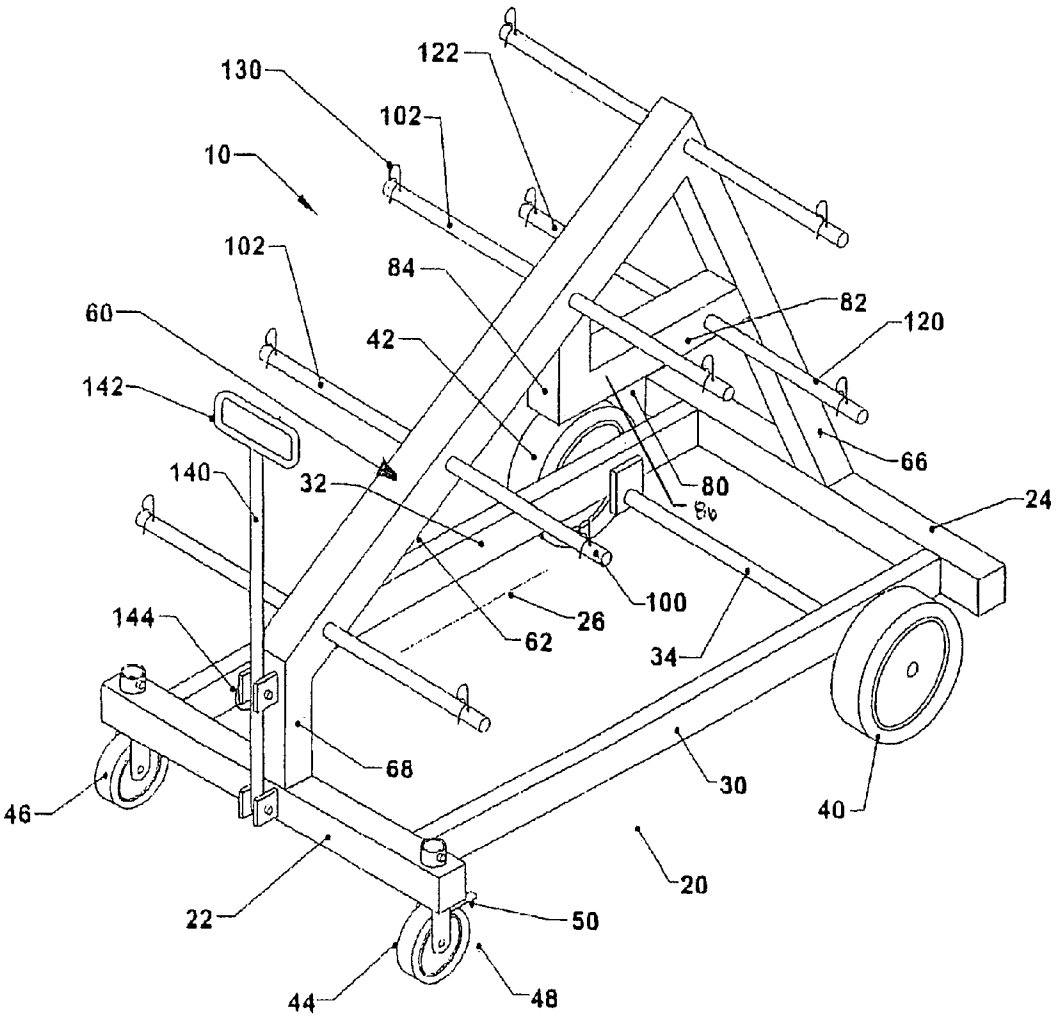
FIG. 1 is a perspective view of a first form of a cart embodying the principles of the present invention.
Figure 3:
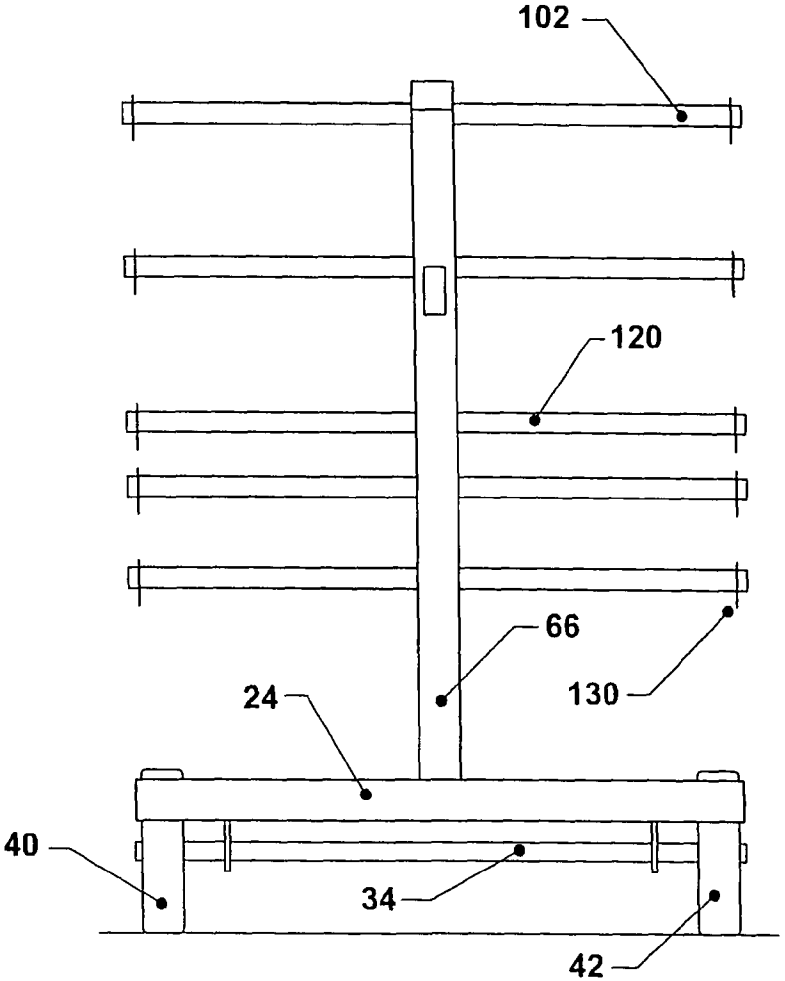
FIG. 3 is a back elevational view of the cart shown in FIG. 1.
Figure 2:
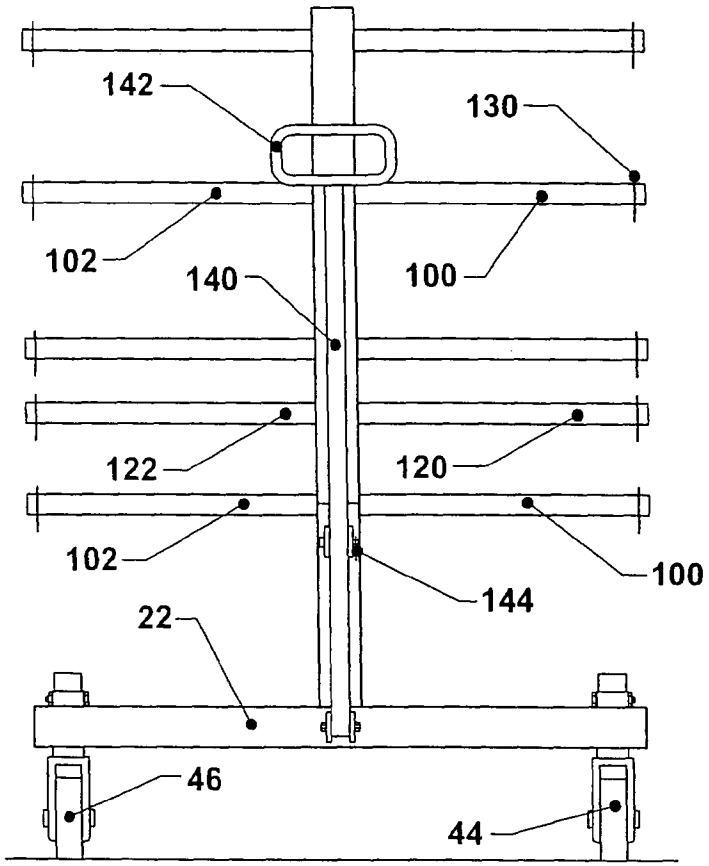
FIG. 2 is a front elevational view of the cart shown in FIG. 1.
Figure 4:
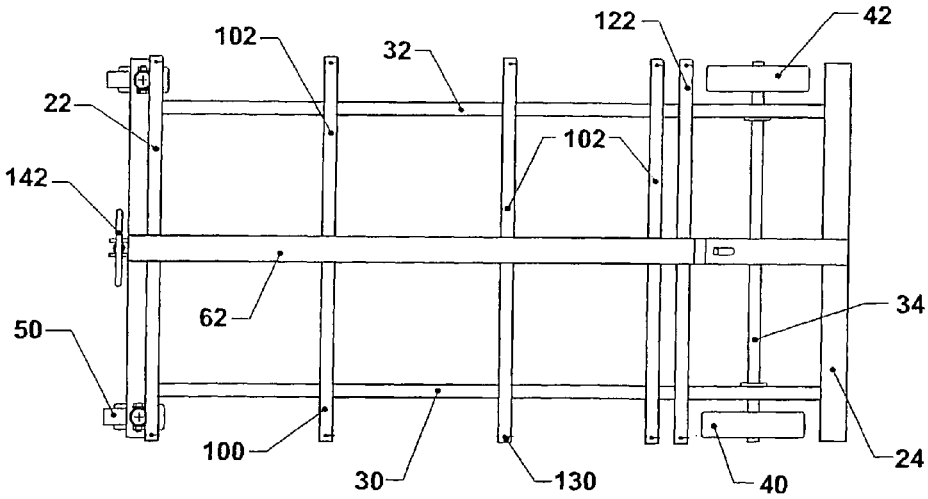
FIG. 4 is a top plan view of the cart shown in FIG. 1.

The first form of the invention is embodied in a cart 10 for supporting and transporting spools of wire. Cart 10 is stable in use and comprises a rectangular base 20 having a first end 22 which is a front end when the cart is in use, a second end 24 which is a rear end when the cart is in use, and a longitudinal axis 26 which extends between the front end and the rear end of the base. Base 20 further includes two side elements 30 and 32 which connect the front end to the rear end and an axle element 34 located adjacent to the rear end.

Cart 10 further includes two non-swiveling wheels 40 and 42 in the rear of the base and two swiveling wheels 44 and 46 in the front of the base. Corresponding wheels are connected together by axles, such as axle 34. A brake element, such as brake element 48, is associated with each swiveling wheel which includes a lever arm, such as lever arm 50, located to be operated by a user's foot to apply and release the brakes as desired.

A frame 60 is supported on the base and is contained in an upright plane when in use. The frame includes an axial member 62 that extends in the direction of the longitudinal axis from superadjacent to front end 22 of the base to a location above and forward of rear end 24. A first support stanchion 66 is mounted on rear end 24 and a second support stanchion 68 is mounted on front end 22 of the base. Axial member 62 is mounted on a distal end of each support stanchion. First support stanchion 66 is longer than second support stanchion 68 whereby axial support member 62 slopes downwardly from the rear end of the frame towards the front end of the frame so the frame forms a convex trapezoidal shape with the base. The downward and forward slope of the axial support member provides stability to the cart.

As used herein, the term "convex trapezoid" means a quadrilateral which has no angle greater than 180°, and the term "concave trapezoid" means a quadrilateral which has at least one angle greater than 180°.

An L-shaped member 80 connects first stanchion 66 to axial member 62 and includes a first leg 82 connected to first stanchion 66 and which extends in the direction of longitudinal axis 26 of the base toward the front end of the frame and a second leg 84 which extends from a distal end 86 of the first leg upward and is connected to the axial member. The legs of the L-shaped member and the axial member and the first stanchion form a convex quadrilateral support member near the rear end of the base. The convex shape of the quadrilateral provides an efficient means to add strength to the frame while at the same time providing an efficient means place wire supporting spools in a desired location for stabilizing the cart in use.

A plurality of spool-supporting arms, such as arms 100 and 102, are mounted on the axial member of the frame, spool supporting arms, such as arms 120 and 122, are mounted on the L-shaped member to extend horizontally when in use. A wire spool retaining locking pin, such as pin 130, is located on a distal end of each spool-supporting arm to hold a wire spool in place on the arm. The spool-supporting arms mounted on the L-shaped member are located between the spool-supporting arms on the axial member of the frame and the base so the spool-supporting members on the L-shaped member are located beneath the spool-supporting members on the axial member of the frame when the cart is in use. The location of the L-shaped frame member with respect to the front and rear ends of the base as well as the wire spools supporting on the L-shaped frame member with respect to the wire spools supported on the axial member add stability to the cart when the cart is in use.

Figure 5:
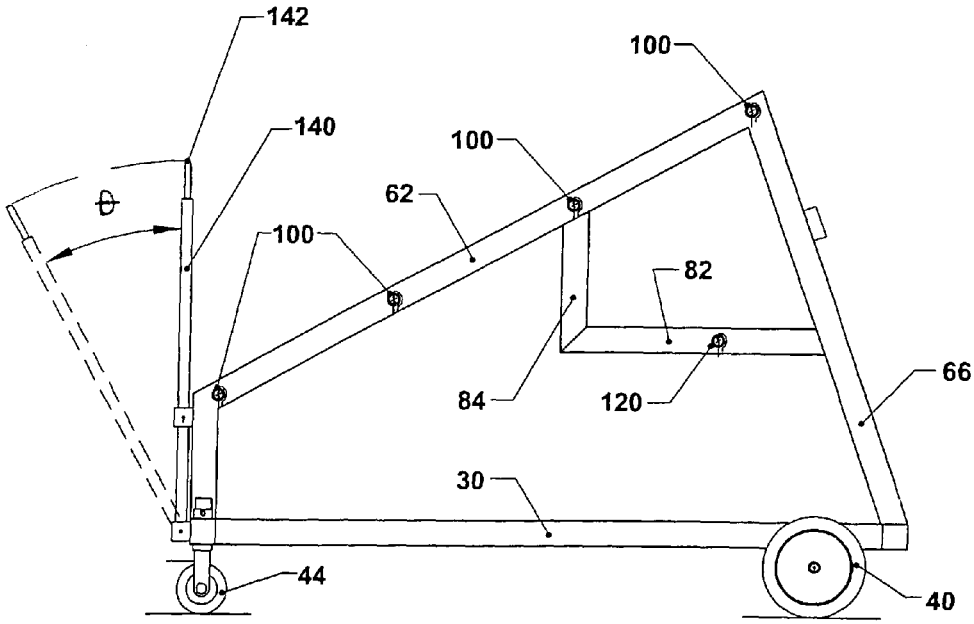
FIG. 5 is a side elevational view of the cart shown in FIG. 1.
Figure 6:
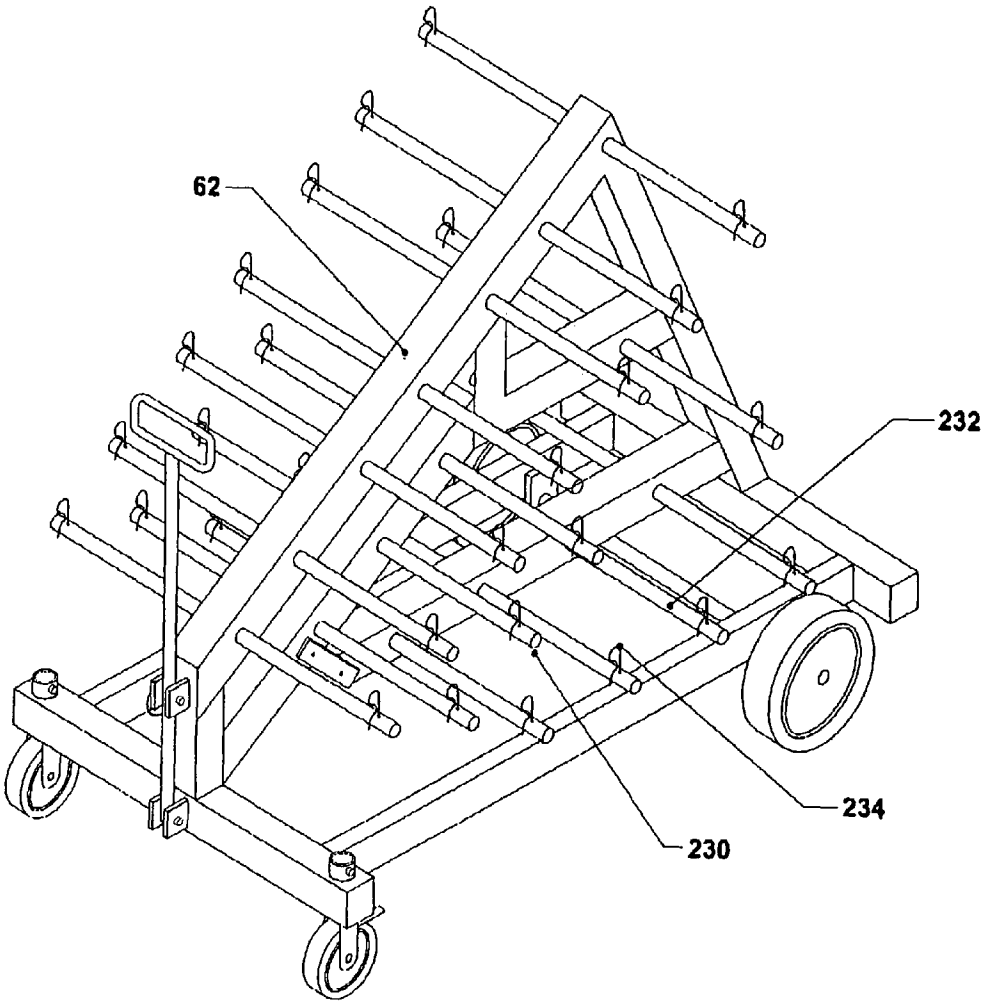
FIG. 6 is a perspective view of another form of a cart embodying the principles of the present invention.
Figure 8:
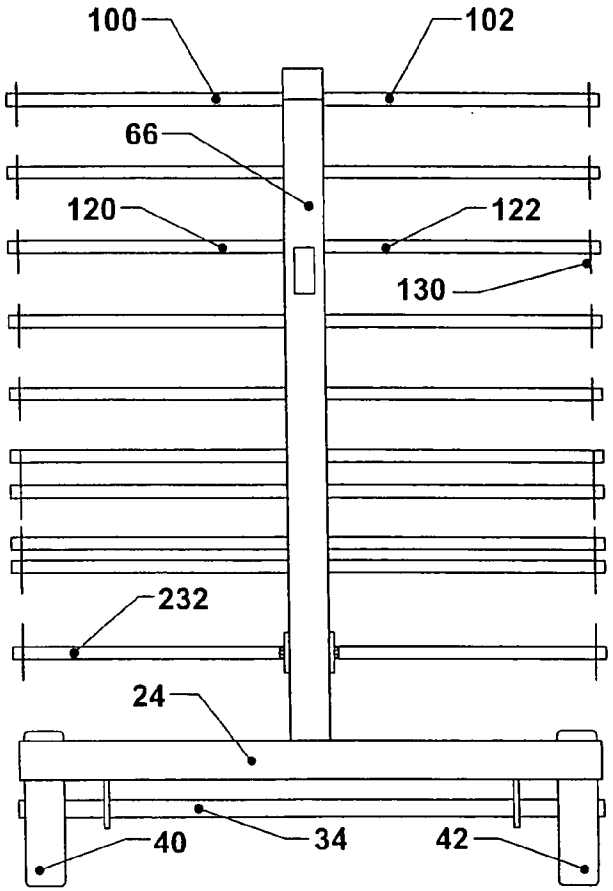
FIG. 8 is a back elevational view of the cart shown in FIG. 6.
Figure 7:
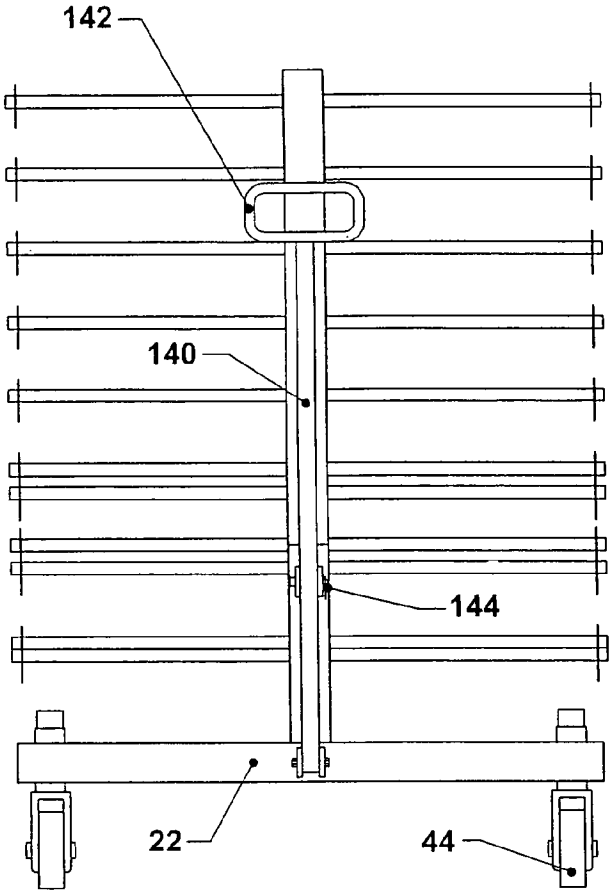
FIG. 7 is a front elevational view of the cart shown in FIG. 6.
Figure 9:
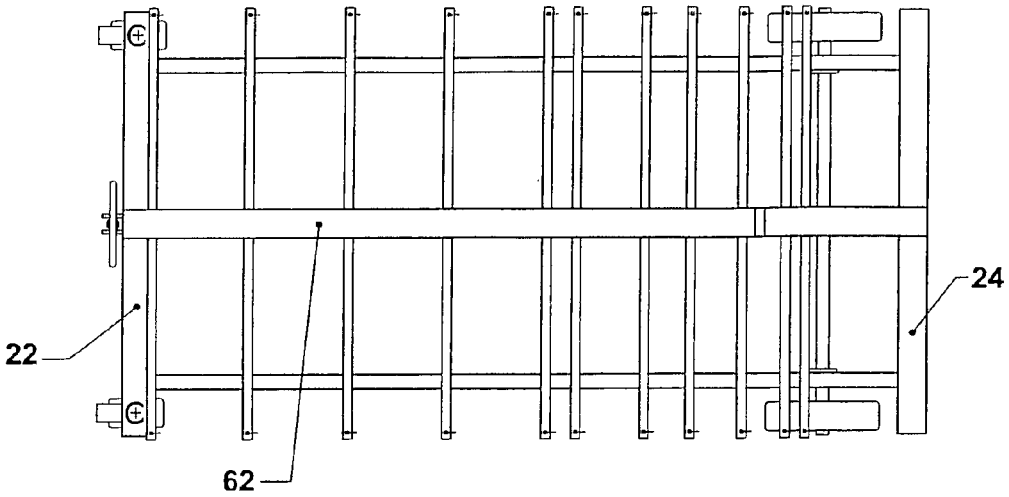
FIG. 9 is a top plan view of the cart shown in FIG. 6.

A handle 140 is pivotally mounted on the frame to move between an upright, stored orientation indicated by solid lines in FIG. 5 and a use orientation indicated in dotted lines in FIG. 5 in which the handle defines an oblique angle θ with respect to horizontal. A wire guide 142 is supported on a distal end of the handle and a lock 144 is located on the handle and on the second stanchion to lock the handle into the stored orientation. In one form, the oblique angle can be as much as 102° total angle.

In the form shown, cart 10 is a ten spool cart for the Electrical Construction Industry. It has a low profile design with all welded eleven gauge steel construction to provide safety and stability when installing electrical building wire into electrical power panels and conduits. It is designed for 2500 foot spools of building wire, sizes 14 gauge through 10 gauge, American Wire size, on wooden or plastic spools of as much as 15 inch diameter, by 12 inch width with 1¼ inch and larger diameter holes. It may also be used for telephone communication, cable television and other wiring spools. The cart has two 4 inch by 2 inch brake and swivel locking stem, non marking caster front wheels with grease inserts and two 8 inch by 2 inch non marking rear wheels with grease inserts providing ease of mobility. The front wheels have 700 lb ratings each and the rear wheels are rated at 500 lb each. The overall cart weighs approximately 108 lbs.

Figure 10:
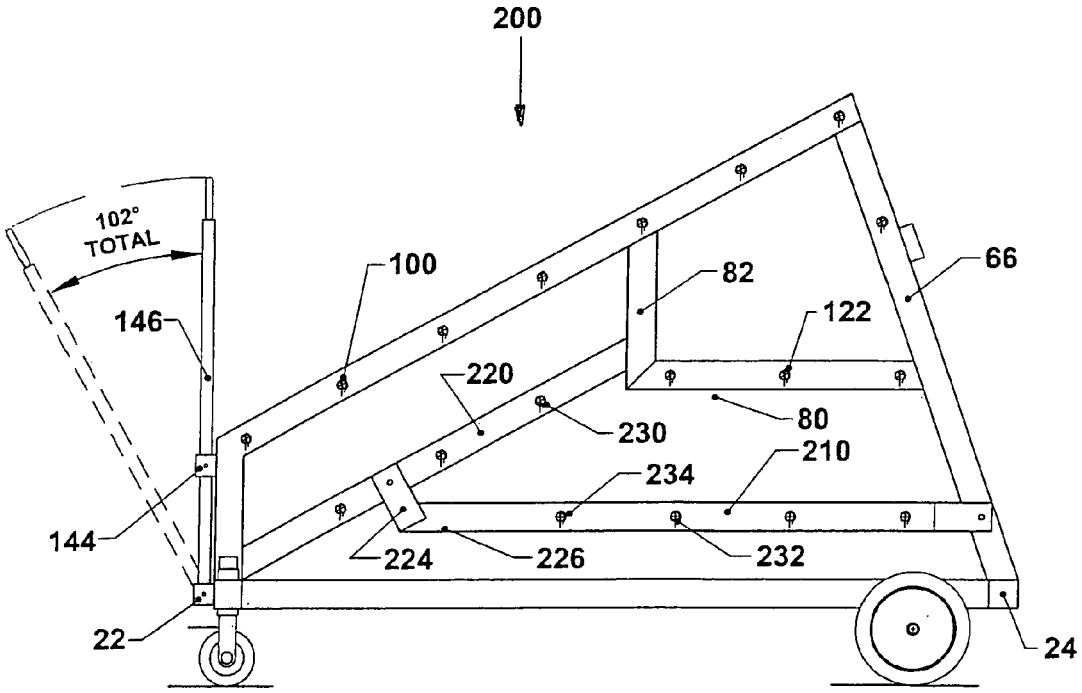
FIG. 10 is a side elevational view of the cart shown in FIG. 6.

A second form of the cart is shown in FIGS. 6-10 and is similar to the first form of the cart discussed above. As best shown in FIG. 10, the second form of the cart is embodied in cart 200 which, in addition to the elements discussed above with reference to the first form of the cart, includes a first connecting link 210 connected at a proximal end thereof to first stanchion 66 and which extends in the direction of longitudinal axis 26 toward front end 22 of the frame. Cart 200 further includes a second connecting link 220 which connects the front end of the frame to second leg 82 of L-shaped member 80 and a connecting element 224 which connects a distal end 226 of first connecting link 210 to second connecting link 220. The first and second connecting links, the first stanchion and the first leg of the L-shaped defining a concave trapezoid. A plurality of spool-supporting arms, such as spool-supporting arms 230 and 232, are mounted on the first and second connecting links and each spool-supporting arm has a wire spool supporting locking pin, such as pin 234, on a distal end thereof.

The L-shaped member in cart 200 has the same function as the L-shaped member in the first form of the cart. That is, the L-shaped member in cart is positioned adjacent to the rear end of the base and to support wire spools beneath wire spools supported on the axial member so extra weight is added both beneath the axial member supported spools and in the rear portion of the base by wire spools supported on the L-shaped frame section when the base is in use so that the base is stable when in use.

Cart 200 is also designed for the Electrical Construction Industry and also has a low profile design with all welded 11 gauge steel construction. Cart 200 is designed for 500 foot spools of building wire, sizes 18 gauge through 10 gauge American wire size, on steel or plastic spools having a diameter of as much as 6½ inch by 4½ inch through 9 inch width and larger diameter holes. As with cart 10, cart 200 can be used for telephone communication, cable television and other wiring on spools. Cart 200 has several modifications as well, with one modification accommodating 108 reels of #18 through 14 AWG wire or 72 reels of #12 AWG wire, or 36 reels of #10 AWG wire. One form of cart 200 weighs 135 pounds and another form of cart 200 weighs 157 pounds.

Figure 11:
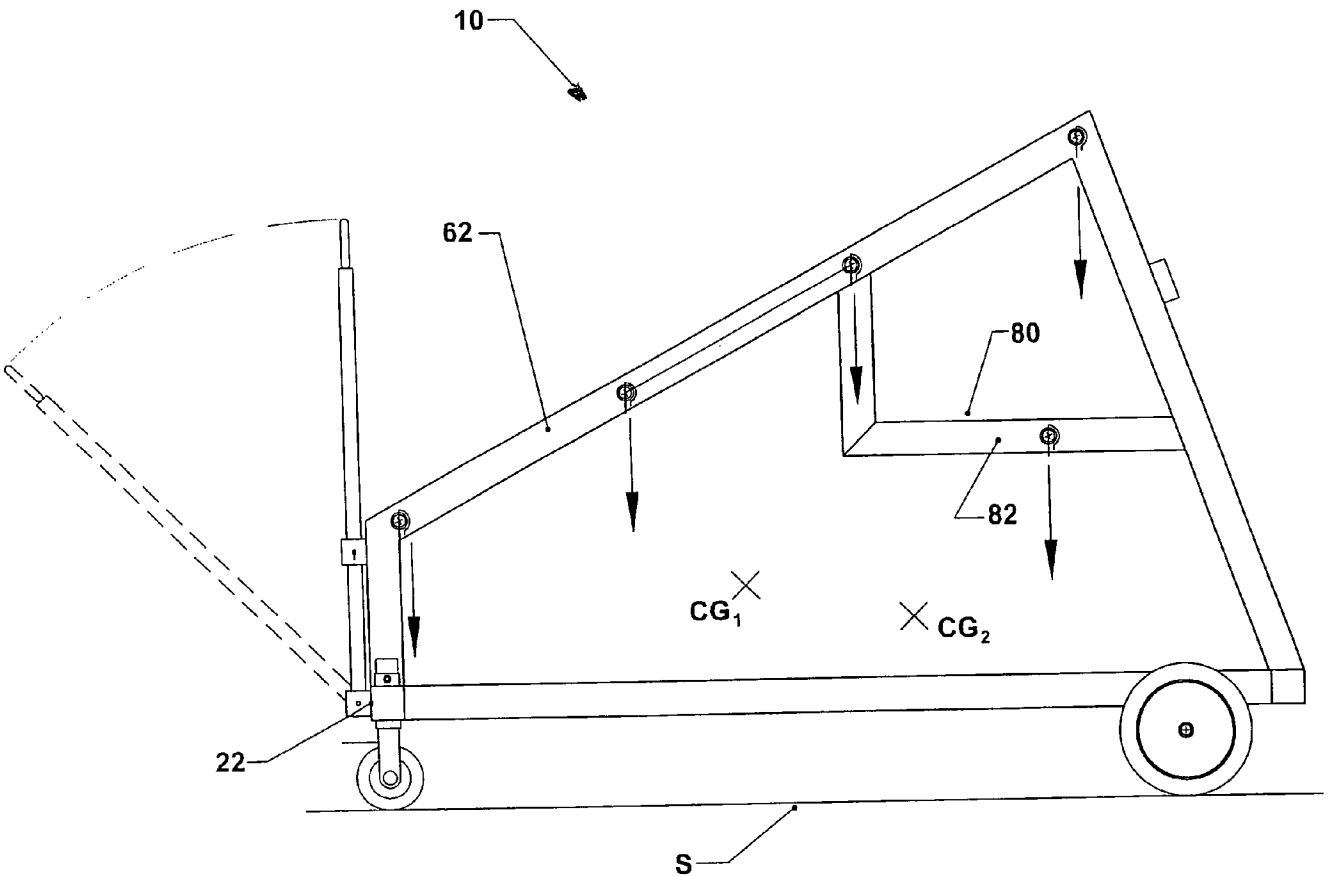
FIG. 11 is a diagram illustrating the result achieved by the cart shown in FIG. 1.
Figure 12:
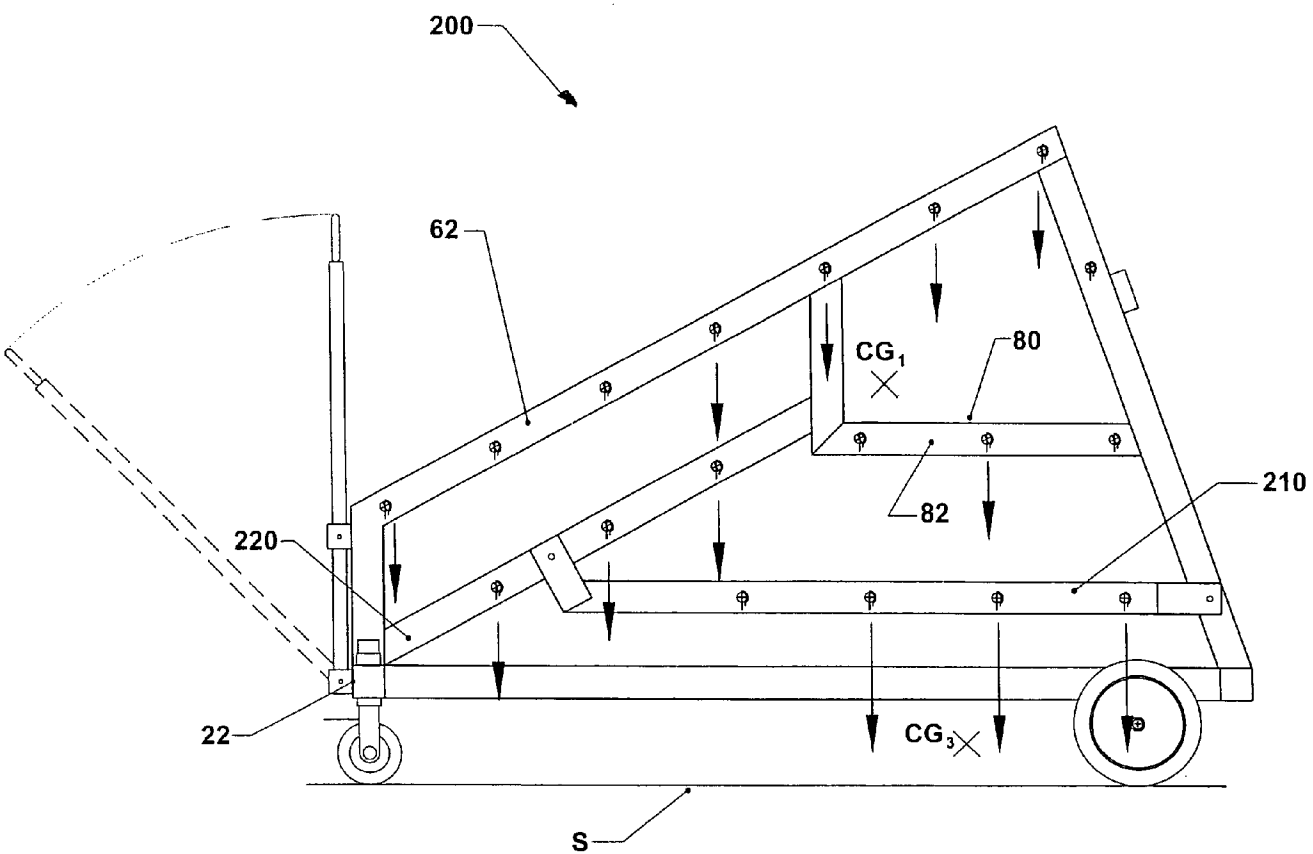
FIG. 12 is a diagram illustrating the result achieved by the cart shown in FIG. 6.

The results achieved by carts 10 and 200 can be understood from the teaching of FIGS. 11 and 12. As can be understood from FIG. 11, a first center of gravity, $CG_1$ is associated with a cart having spools supported only on axial member 62; whereas the center of gravity is moved rearwardly and downwardly by the weight of spools supported on both axial member 62 and on L-shaped member 80 to ro $CG_2$ As can be seen, center of gravity $CG_2$ is rearward and lower than center of gravity $CG_1$ with respect to front end 22 and support surface S. Lowering the center of gravity and moving it rearward on the cart adds stability to the cart as a vehicle having a lowered center of gravity is generally more stable than the same vehicle with a higher center of gravity. FIG. 12 illustrates the same principle with reference to cart 200, with the center of gravity of cart 200 being lowered from $CG_1$ which is associated with a cart having spools supported only on axial member 62 to a position rearward and lower with respect to front end 22 and support surface S than $CG_1$ as indicated by center of gravity $CG_3$. Center of gravity $CG_3$ is even lower than center of gravity $CG_2$ due to the additional weight associated with spools supported on first connecting link 210 and on second connecting link 220. Again, lowering the center of gravity and moving it rearward increases the stability of the cart.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A cart for supporting and transporting spools of wire, the cart comprising:

A) a base having a front end, a rear end and a longitudinal axis extending between the front end of the base and the rear end of the base;

B) a frame supported on the base, the frame including (1) an axial support member that extends in the direction of the longitudinal axis between the front end of the base and rear end of the base, (2) a first support stanchion mounted on the base adjacent to the rear end of the base, (3) a second support stanchion mounted on the base adjacent to the front end of the base, (4) the axial support member having one end thereof connected to the first support stanchion and a second end connected to the second support stanchion, the axial support member sloping downwardly from the rear of the base towards the front of the base, and (5) an L-shaped member which connects the first support stanchion to the axial support member, the L-shaped member including (a) a first leg which is connected at a first end thereof to the first support stanchion and which extends toward the front end of the base in a horizontal direction, the first leg of the L-shaped member having a second end, the second end of the first leg of the L-shaped member being located between the axial support member and the base, and (b) a second leg which is connected at a first end thereof to the axial support member and having a second end connected to the second end of the first leg of the L-shaped member, the second leg of the L-shaped member extending from the axial member toward the base;

C) a plurality of spool-supporting arms mounted on the axial support member of the frame to extend in a horizontal direction;

D) a plurality of spool-supporting arms mounted on the L-shaped member to extend in a horizontal direction; and E) a handle pivotally mounted on the frame.

2. The cart defined in claim 1 wherein the supporting arms on the L-shaped member located beneath the spool supporting arms on the axial support member so stability is added to the cart by the location of the spool supporting arms on the L-shaped member.

3. The cart defined in claim 1 wherein the L-shaped member and the axial support member define a convex quadrilateral shape.

4. The cart defined in claim 1 further including a wire guide on the handle.

5. The cart defined in claim 4 further including a lock on the handle.

6. The cart defined in claim 1 further including a plurality of wheels on the base, with some of the wheels being mounted on the base to swivel with respect to the base.

7. The cart defined in claim 1 wherein each spool-supporting arm has a distal end and a hitch pin clip mounted thereon.

* * * * *